United States Patent [19]

Minihane

[11] 3,988,840

[45] Nov. 2, 1976

[54] SOLE CONSTRUCTION

[75] Inventor: Robert P. Minihane, Concord, Mass.

[73] Assignee: Hyde Athletic Industries, Inc., Cambridge, Mass.

[22] Filed: May 7, 1975

[21] Appl. No.: 575,576

[52] U.S. Cl. ..... 36/32 R

[51] Int. Cl.[2] ..... A43B 13/06

[58] Field of Search ..... 36/25 R, 32 R, 2.5 A, 36/2.5 AG, 2.5 AK, 67 R, 67 A, 59 R, 2.5 H, 59 C

[56] References Cited

UNITED STATES PATENTS

| | | | |
|---|---|---|---|
| 2,038,972 | 4/1936 | Watanabe | 36/32 R |
| 3,494,055 | 2/1970 | McSorley | 36/2.5 AG |
| 3,593,436 | 7/1971 | Vietas | 36/32 R |

*Primary Examiner*—G. V. Larkin

*Attorney, Agent, or Firm*—Wolf, Greenfield & Sacks

[57] ABSTRACT

An athletic shoe intended for use on a synthetic turf is constructed of a resilient plastic and has a sole that is constructed with a plurality of cleats uniformly spaced in both the ball area and heel area of the sole. The sole is also lined with spaced peripheral cleats that are shorter in height than the other cleats and include two elongated cleats at the front and back, respectively, of the sole.

12 Claims, 4 Drawing Figures

2
3
4
10
12
14
16
20
22
24
25
26
27
30
32
36
a
b

SOLE CONSTRUCTION

BACKGROUND OF THE INVENTION

The present invention relates, in general, to a cleated athletic shoe. More particularly, this invention is concerned with an improved athletic shoe intended for use on a synthetic turf.

A typical cleated sole is shown in U.S. Pat. No. 2,038,972. This patent teaches the use of separate groups of cleats in the heel area and ball area of the sole. However, the sole disclosed in this patent was not intended for use on a synthetic turf. The design of a sole for use on a natural surface is not necessarily the best design for use on a synthetic surface. On a natural surface the cleats can dig into the soil for adequate gripping, whereas regarding a synthetic surface the cleats cannot dig into the synthetic surface.

In accordance with the present invention, it has been realized that to provide adequate gripping on synthetic turfs, the sole has to be designed to provide maximum frictional interengagement between the sole and the turf.

Accordingly, one object of the present invention is to provide an improved athletic sole construction particularly designed for use on synthetic turfs.

Another object of the present invention is to provide a sole construction for use on synthetic turfs, which construction provides maximum frictional interengagement between the sole and the synthetic material. The gripping is enhanced by use of a relatively large number of uniformly disposed cleats in both the heel and sole areas.

A further object of the present invention is to provide a cleated sole for use on synthetic turfs that provides improved gripping between the sole and the turf, that is easily fabricated by a molding technique and that is durable and relatively inexpensive to fabricate.

Still another object of the present invention is to provide a sole construction for use on synthetic turfs that provides good traction and prevents slipping which may occur when a player attempts to make an abrupt turn or cut when running.

SUMMARY OF THE INVENTION

To accomplish the foregoing and other objects of this invention, there is provided a sole for shoes, which sole is primarily for use on a synthetic turf. The sole may be for use on athletic football shoes. The sole basically comprises a base, a plurality of cleats disposed in relatively uniformly spaced relationship in the sole or ball area and heel area, respectively, and a plurality of somewhat elongated cleats peripherally disposed about the edge of the sole and including opposite end cleats that are arcuate in shape and longer than the other elongated cleats. The cleats that are disposed in the sole area and the heel area are preferably frustoconically shaped and a space is preferably provided in the area between these two groups of cleats which is free of the cleats. There may typically be ten uniformly disposed cleats in the heel area and twenty-five uniformly displaced cleats in the sole or ball area. It is also preferred that the cleats in the ball and the heel area be higher or extend further from the base than the peripheral cleats. The frustoconic cleats may extend on the order of twice the distance from the base as the peripheral cleats. This arrangement provides improved gripping and traction of the sole to the synthetic turf.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figures 1, 2, 3, 4:
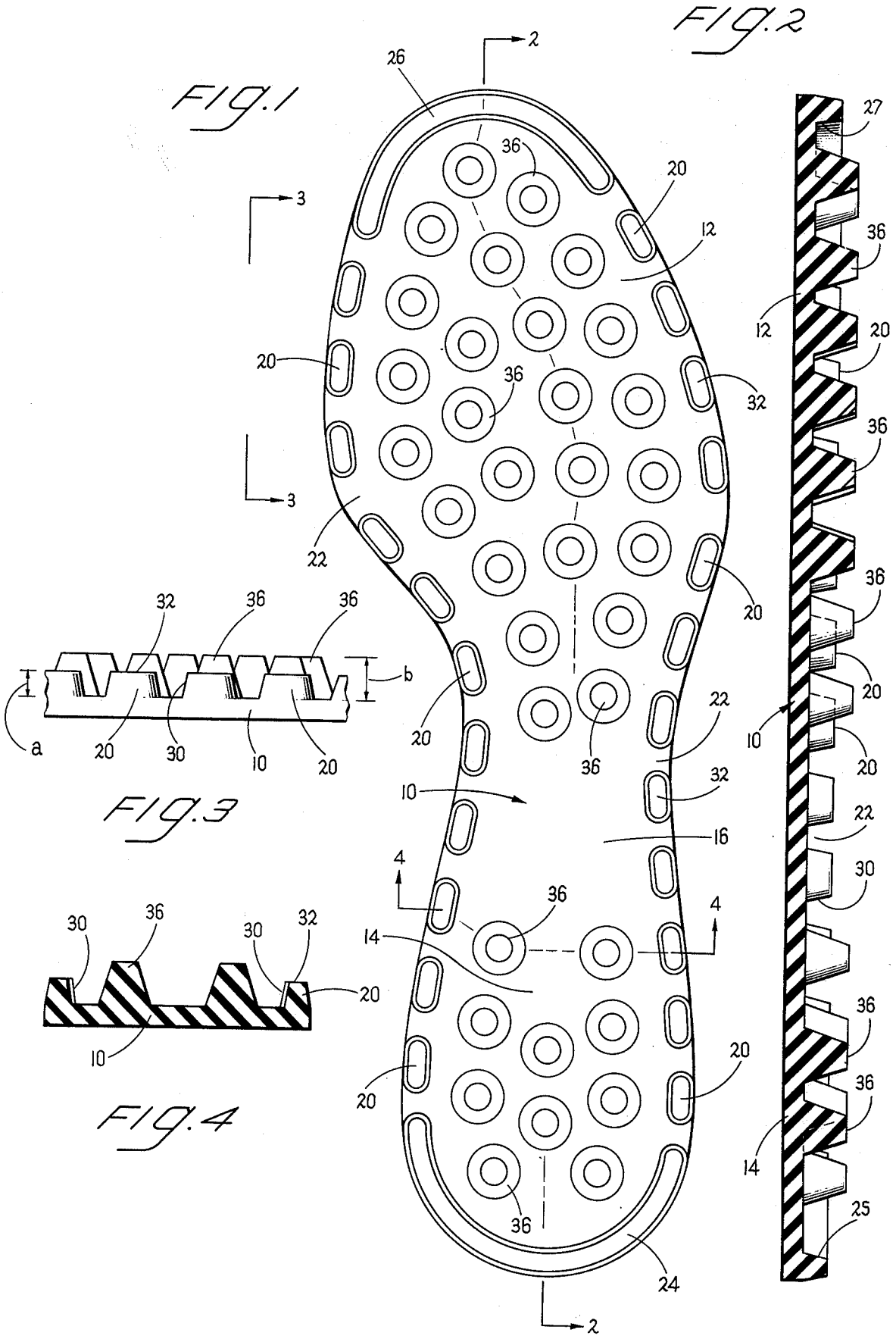
FIG. 1 is a plan view of the shoe sole embodying the present invention.
FIG. 2 is a cross sectional view taken along line 2—2 of FIG. 1.
FIG. 3 is a side view of the sole as taken along line 3—3 of FIG. 1.
FIG. 4 is a cross sectional view taken along line 4—4 of FIG. 1.

Referring to the drawings which illustrate a preferred embodiment of the present invention, there is shown a shoe sole that is designed for a variety of athletic shoes primarily used on synthetic turfs. These soles may, for example, be attached to football, baseball and other types of athletic footwear in which it is ordinarily necessary to move in a variety of directions with sudden turns. The sole is particularly useful in connection with football shoes.

As illustrated, there is provided a shoe sole formed of a single piece of a flexible resilient material. This material may be formed of a suitable sole material such as relatively hard rubber or plastic that affords some degree of flexibility and resiliency and at the same time provides enough structural strength for gripping as hereafter described. The gripping means of the sole and the general configuration of the sole may be fabricated by a molding technique well known in the art.

Referring to the drawings, the sole comprises a base 10 that may be considered as being sectioned into three areas including a sole or ball area 12, a heel area 14 and a bridge area 16.

The sole 10 is lined about its periphery with a plurality of somwhat elongated cleats 20, which are evenly spaced along the periphery of the sole and define a space 22 therebetween. In order to provide improved gripping and turning action there is also provided a rear or heel cleat 24 which is of arcuate shape and a toe cleat 26 which is also of arcuate shape as particularly indicated in FIG. 1.

Each of the peripheral cleats 20 has a somewhat oblong shape with a continuous tapered wall 30 that terminates in engagin surface 32 of the cleat.

The elongated arcuate cleats 24 and 26 also have respective continuous tapered walls 25 and 27.

Within the periphery defined by the peripheral cleats 20 there are disposed a plurality of frustoconically shaped cleats 36. The majority of these cleats which total approximately twentyfive are disposed in a uniform fashion in the ball or sole area 12 of the sole 10. There are no cleats 36 disposed in the bridge area 16. A minority of the cleats 36 are disposed in the heel area 14. The cleats in the heel area are uniformly disposed over the area as shown in FIG. 1. Improved gripping and turning is provided by this relatively large number of cleats in both the heel and ball areas which are also uniformly disposed.

Another important aspect of the present invention that contributes to the improved operation of this sole construction has to do with the difference in height between the cleats 36 and cleats 20. The height of the cleat 20 is represented by the dimension (*a*) and the height of the cleat 36 is represented by the dimension (*b*). The (*a*) dimension may be for example, 3/16th of an inch and the (*b*) dimension may, for example, be 5/16th of an inch. Thus, the ratio between the height of the cleat 20 and the height of the cleat 36 may be a 3 to 5 ratio. In a slightly alternative embodiment, the ratio between the two heights could also be a 1 to 2 ratio.

Having described one embodiment of the present invention it should now be apparent to those skilled in the art that numerous other embodiments are contemplated as falling within the scope of this invention. The scope is to be determined by the appended claims.

What is claimed is:

1. A sole for shoes comprising a base, a first plurality of cleats extending from the base and disposed in two groups with the cleats of each group being disposed in relatively uniformly spaced relationship, said groups being disposed in the sole area and heel area, respectively, said groups of cleats being separated by an area between the groups that is absent first plurality cleats, and a second plurality of elongated cleats spacedly and peripherally disposed about the entire edge of the sole base including about the sole and heel areas and including a majority of substantially straight cleats and opposite end cleats that are arcuate and longer than the other elongated cleats.

2. A sole as set forth in claim 1 wherein each cleat of the first plurality of cleats has a frustoconic shape and all of those cleats are of similar size.

3. A sole as set forth in claim 1 wherein said sole group of cleats numbers about twenty-five and said heel group of cleats numbers about ten.

4. A sole as set forth in claim 3 wherein the elongated cleats are spaced uniformly about the shoe sole.

5. A sole as set forth in claim 4 wherein the cleats of the first plurality are higher than the cleats of the second plurality.

6. A sole as set forth in claim 5 wherein the ratio between the heights is five to three.

7. A sole as set forth in claim 1 wherein the cleats of the first plurality are higher than the cleats of the second plurality.

8. A sole as set forth in claim 7 wherein the cleats of the first plurality are on the order of twice the height as the cleats of the second plurality.

9. A sole as set forth in claim 1 wherein the cleats of the second plurality of cleats are each defined by a slanted peripheral surface and a flat end surface.

10. A sole as set forth in claim 1 wherein the cleats of the second plurality of cleats each extend in a longitudinal direction relative to the edge of the base and each have an edge that is tangential to the edge of the base.

11. A sole as set forth in claim 1 wherein the cleats of the first plurality of cleats have a frustoconic shape and the cleats of the second plurality of cleats are each defined by a slanted peripheral surface and a flat end surface, the cleats of the first plurality being arranged in larger number in the sole group than in the heel group, the cleats of the second plurality of cleats each extending in a longitudinal direction relative to the edge of the base and each having an edge that is tangential to the edge of the base, said opposite end cleats and said majority of substantially straight cleats all having the same width.

12. A sole as set forth in claim 1 wherein the majority of substantially straight cleats cover a longer length of the peripheral edge of the sole than the opposite end cleats cover.

* * * * *